United States Patent [19]

Vertegaal et al.

[11] Patent Number: 4,656,942

[45] Date of Patent: Apr. 14, 1987

[54] PRINTING APPARATUS UTILIZING FLEXIBLE METAL SLEEVES AS INK TRANSFER MEANS

[75] Inventors: Jacobus-Gerardus Vertegaal, Boxmeer; Lodewijk Anselrode, St. Anthonis, both of Netherlands

[73] Assignee: Stork Brabant B.V., Boxmeer, Netherlands

[21] Appl. No.: 205,896

[22] Filed: Nov. 12, 1980

Related U.S. Application Data

[63] Continuation of Ser. No. 57,267, Jul. 13, 1979, abandoned, which is a continuation of Ser. No. 864,332, Dec. 27, 1977, abandoned.

[51] Int. Cl.[4] ..... B41F 27/12

[52] U.S. Cl. ..... 101/426; 101/375; 101/DIG. 13

[58] Field of Search ..... 101/348, 375, 376, DIG. 13, 101/415.1, 148, 349, 426; 29/113 R, 113 AD; 355/3 DR, 3 SC, 92; 100/163 R, 163 A, 170

[56] References Cited

U.S. PATENT DOCUMENTS

| | | | |
|---|---|---|---|
| 776,000 | 11/1904 | Turner | 29/113 R |
| 2,144,793 | 1/1939 | Christensen | 29/113 R |
| 2,182,176 | 12/1959 | Maranville | 29/113 R |
| 2,255,410 | 9/1941 | Case | 101/348 X |
| 2,289,453 | 7/1942 | Randall | 29/113 R |
| 2,987,994 | 6/1961 | Allison | 29/113 R X |
| 3,006,277 | 10/1961 | Willard | 101/378 |
| 3,224,698 | 12/1965 | Conti | 29/113 R X |
| 3,253,323 | 5/1966 | Saueressig | 29/113 R |
| 3,640,218 | 2/1972 | Allison | 101/375 |
| 3,695,757 | 10/1972 | Gregory | 101/378 |
| 4,025,339 | 5/1977 | Kuehnle | 252/501 X |
| 4,255,508 | 3/1981 | Kuehnle | 355/3 DR X |

FOREIGN PATENT DOCUMENTS

| | | | |
|---|---|---|---|
| 219268 | 1/1962 | Austria | 101/375 |
| 240879 | 5/1963 | Austria | 101/375 |
| 279107 | 10/1914 | Fed. Rep. of Germany | 29/113 R |
| 1181237 | 11/1964 | Fed. Rep. of Germany | 101/375 |
| 1231258 | 12/1966 | Fed. Rep. of Germany | 101/375 |
| 789177 | 1/1958 | United Kingdom | 101/375 |
| 975147 | 11/1964 | United Kingdom | 101/375 |

*Primary Examiner*—J. Reed Fisher

*Attorney, Agent, or Firm*—Silverman, Cass, Singer and Winburn, Ltd.

[57] ABSTRACT

Printing apparatus utilizing flexible metal sleeves comprises means for mounting the sleeves in cylindrical configuration in a device which maintains their cylindrical configuration by means of fluid which is applied to and maintained within the sleeves under pressure during their use. The sleeves are of the type which is made by electrodepositing metal in a form that is very thin, readily collapsible and imperforate.

Several structures for supporting the sleeves are disclosed. The sleeves are provided on their exteriors with coatings of flexible, microcrystalline, wholly inorganic photoconductive material such as sputtered ultrapure cadmium sulfide.

A method of mounting the sleeve is disclosed.

16 Claims, 7 Drawing Figures

PRINTING APPARATUS UTILIZING FLEXIBLE METAL SLEEVES AS INK TRANSFER MEANS

This is a continuation of application Ser. No. 57,267, filed July 13, 1979, now abandoned, which was, in turn, a continuation of Ser. No. 864,332 filed Dec. 27, 1977, now abandoned.

FIELD AND BACKGROUND OF THE INVENTION

The field of the invention is printing apparatus and more particularly the invention is concerned with the construction of cylinders for transferring pigment to a substrate using electrostatic techniques. The advantages of the invention are especially applicable in the printing of multicolor images on substrates which are either in long strip form or in the form of sheets of paper, fabric and the like.

Multicolor printing by conventional presses is a complex process from the point of making the color separations, forming the cylinders, operating the presses, providing the pigment or inks for the separate cylinders or other plates, etc.

Several developments in recent years have pointed to the use of electrostatic techniques for multicolor printing in printing presses using electrostatic techniques. As known, photoelectrostatic imaging is effected by charging the surface of a photoconductive coating in darkness, exposing the same to a light image, then toning the latent image with fine particles either in powder form or suspended in a solvent. The toned or developed image may either be transferred to a receptor or it may be fused in place directly onto the electrophotographic member of which the photoconductive coating is a part.

One of the coatings which has been evolved recently is a high gain, high resolution, easily charged, fully dischargeable, wholly inorganic, microcrystalline photoconductive material which has especially the property that it is rugged and extremely flexible when coated onto a thin flexible substrate. The material is disclosed in U.S. Pat. No. 4,025,339. This coating is advantageous in addition to being flexible in that it can be imaged quickly in a high speed press and discharged readily by ambient light so that, as will be explained, it may be provided with an image of toner that is insulating and thereafter charged to apply a charge to the insulating toner while permitting the charge on the untoned areas to be dissipated in light. Then secondary toner can be adhered to the primary toned image and transferred to a substrate.

Thin-walled metal sleeves of electrodeposited nickel, copper or other metal have been used in the fabric and other substrate printing field with success. These sleeves are a fraction of a millimeter thick and can be several meters long and as much as a third of a meter in diameter. They are seamless and are readily supported in printing machines. The sleeves which have been used heretofore are disclosed in U.S. Pat. No. 2,287,122 and have been foraminous in order to enable ink or other pigment to be expressed by doctor means through the walls of the cylinders onto the passing substrate. The walls are provided with suitable designs in the surface blocking certain of the holes and leaving others open.

For electrostatic use, these sleeves are sputtered with coatings of the photoconductive material which has been mentioned and are imperforate. An important advantage of this type of sleeve is that it is light in weight, it is quite strong and is collapsible so that packing and shipping the same is economical. In using the sleeves they must be mounted in cylindrical form on the printing press to receive and transfer the pigment. They need to be supported on their interiors by using some readily installed or removed device which must maintain the sleeves in rigid cylindrical form all the period of time that the cylinders are in use.

The invention contemplates the provision of the means for enabling the sleeves with photoconductive coatings to be used efficiently and easily.

Reference may be made to the following prior art: Rothwell U.K. Pat. No. 789,177, published Jan. 15, 1958; Klemm W. German Auslegeschrift No. 1,231,258 published Dec. 29, 1966 Zimmer Austria Pat. No. 240,879, June 25, 1965; Zimmer W. German Auslegeschrift No. 1,181,237 published Nov. 12, 1964 Wagter U.S. Pat. No. 3,372,801, Mar. 12, 1968.

All of these references but the last disclose the pressurizing of sleeves by means of an inflatable tube. The instant invention, in one of its forms uses an inflatable elastomeric tube for inflation, but it is important to recognize that in the prior art the cylinders are being processed to have a pattern applied on their exterior (U.K. No. 789,177; DAS No. 1,181,237; Austria No. 240,879) or to produce a sleeve in a galvanic process (DAS No. 1,181,237). The use of a pressurized sleeve for a printing process and its mounting in a high speed printing press is not disclosed, taught or contemplated by this prior art. The U.S. patent referred to merely relates to the packing of flexible sleeves as explained herein.

SUMMARY OF THE INVENTION

According to the invention, a sleeve of thin-walled metal with a photoconductive coating on the exterior thereof and which is imperforate is mounted on a device that is readily handled and upon which the sleeve is readily installed or from which it is readily removed.

The supporting device is likewise readily attached to and removed from a printing press.

The supporting device provides means for clamping the ends of the sleeve firmly while holding the sleeve in a cylindrical configuration and means for introducing pressure on the interior of the sleeve by the medium of a fluid pumped into the interior of the sleeve. The sleeve must be maintained in such a manner that fluid will not escape therefrom.

The fluid may be pumped directly against the interior of the sleeve or may be applied indirectly by means of an inflatable boot over which the sleeve is telescopically engaged. Various means for clamping the ends of the sleeve are described, including adhesive, pneumatic cushions and the like.

The invention includes a method of mounting the sleeve.

DESCRIPTION OF THE PREFERRED EMBODIMENTS

The invention is generally concerned with printing but more specifically it is concerned with printing apparatus which utilizes flexible metal cylinders having a photoconductive coating on their surfaces.

Figure 1:
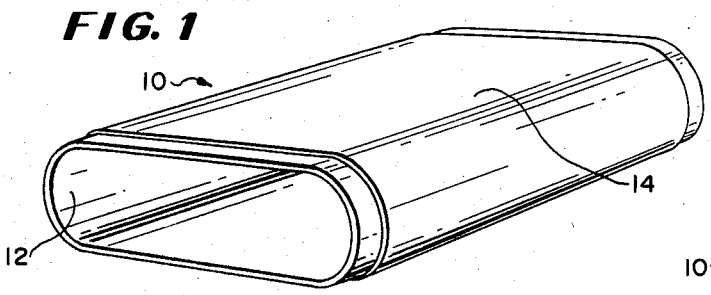
FIG. 1 is a perspective view of a sleeve of the type which is to be mounted by means of the apparatus of the invention and held in a rigid cylindrical configuration to enable the same to be used as ink transfer means in a printing press.

In FIG. 1 there is illustrated in perspective view the type of cylinder 10 which is used with the invention, the same being based upon a sleeve 12 which has been formed by electrodeposition out of nickel, copper or the like, being quite thin—of the order of a small fraction of a millimeter and hence flexible. Upon these sleeve 12 there is sputtered a thin film coating 14 of a wholly inorganic, microcrystalline, highly sensitive, readily chargeable photoconductive material such as for example ultrapure cadmium sulfide. The characteristics of the material and the method of sputtering the same are disclosed in said U.S. Pat. No. 4,025,339. The techniques for the electrodeposition of the metal sleeve 12 and some of the characteristics thereof are described in said U.S. Pat. No. 2,287,122 with the exception that the metal sleeve 12 is imperforate instead of foraminous as disclosed in said latter patent.

In the formation of the metal sleeve 12 the resulting product is normally cylindrical and likewise, in sputtering the coating 14 the configuration of the sleeve 12 will be maintained in cylindrical form, but there are other methods and apparatus which enable at least the sputtering to be carried on with the metal sleeve 12, forming the substrate for the coating in an oval configuration.

Figure 2:
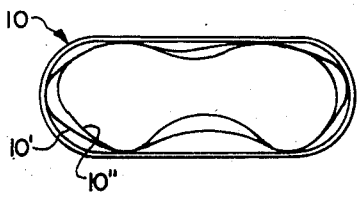
FIG. 2 is a sectional view through several of such sleeves showing the convenient manner in which they may be assembled for storing or transportation in small space.

In the mounting of the sleeve or cylinder 10, it will invariably be in a cylindrical configuration for high speed printing presses, especially multi-color presses. Nonetheless the sleeve 10 is to some extent collapsible without damage to either the substrate of metal or the coating of microcrystalline photoconductive material. The metal substrate comprising the sleeve 12 is stiff enough to handle, for example in a size which has a length of about two meters and a diameter which is about a sixth of a meter without axial collapsing or wrinkling, but can be readily compresed or collapsed laterally along its entire length to enable it to be shaped for example into oval form as shown in FIG. 1. Likewise it can be partially rolled into reentrant shapes to occupy considerably less volume than when it is in its full cylindrical configuration as disclosed in said U.S. Pat. No. 3,372,801. This enables many of these sleeves to be packaged in a single small package as shown in FIG. 2 in which there are two additional sleeves 10′ and 10″ within the sleeve 10. Obviously more than two such sleeves can be compressed into a single bundle.

Figure 3:
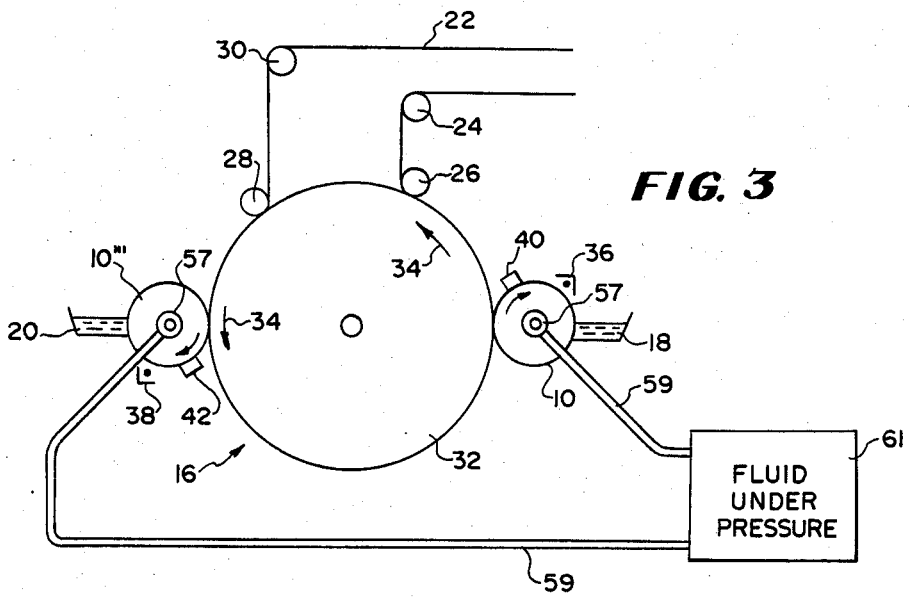
FIG. 3 is a highly diagrammatic view of a printing press having two of the cylinders of the invention associated therewith in order to show the environment of the invention.

Reference may now be made to FIG. 3 which illustrates the environment in which the sleeve 10 of the invention is intended to be used. Here the very barest essentials of a printing press 16 are shown, this being of a type which is intended to apply two colors of ink or dye carried in the fountains 18 and 20 in registration on a long strip-like substrate 22 of paper or the like. The substrate 22 is guided by means of the rolls 24, 26, 28 and 30 to pass around a back-up roll 32 against which the printing will occur. Two cylinders of the type described are shown at 10 and 10‴. The direction of rotation of the drum 32 is indicated by the arrows 34, the direction of each of the cylinders 10 and 10‴ being indicated by arrows marked on the cylinders.

In this apparatus 16, the cylinders 10 and 10‴ will be presumed to have images carried on their outer surfaces as primary toned images. These can be applied while the cylinders 10 and 10‴ are off the apparatus 16 and the cylinders thereafter installed in the apparatus. One of the benefits of this invention is concerned with the ease with which the cylinders can be readily mounted for use in the apparatus 16.

In use the cylinders are charged by suitable corona means at 36 and 38, the charging occurring in light so that the charges on the photoconductive coatings are immediately dissipated leaving only the charges on the primary toner. The type of toner chosen is one which is insulating when developed, that is, fused. The fountains 18 and 20 contain the ink or dye which comprises the secondary toner. The polarity of the particles of the secondary toner is established as the opposite of that of the charge on the primary toner. This can be done electrophoretically or by triboelectric techniques. As the charged images pass the fountains 18 and 20 they will pick up the secondary toner from the respective fountains and apply the same to the surface of the substrate 22. Electrical bias may be used to assist in this transfer. Transfer will be done in registration.

After the transfer has been completed and the images pass the nip between the cylinders and the back-up roller 32 the printing cycle is repeated. Although not normally required, remaining secondary toner, if any, may be removed from the surfaces of the cylinders 10 and 10‴ by suitable solvents or mechanical means at stations 40 and 42 with suitable solvents and/or mechanical means which do not affect the primary toner.

The apparatus 16 is just by way of example. For instance, the cylinders 10 and 10‴ could be provided with developed toned images and treated with suitable reagents or chemicals to render the toned surfaces hydrophobic and the untoned surfaces hydrophyllic to enable the cylinders to be used as printing cylinders with greasy ink in watered offset printing presses.

The use of the cylinders in the type of printing apparatus operating by means of electrostatic techniques is preferred.

As described in the background of the invention, the cylinder 10 is required to be perfectly cylindrical and relatively rigid during its use and with its mounting or support be easily installed and removed from the printing press on which it is to be used. Likewise it is required to be easily installed and removed from the mounting which carriers it.

Figure 4:
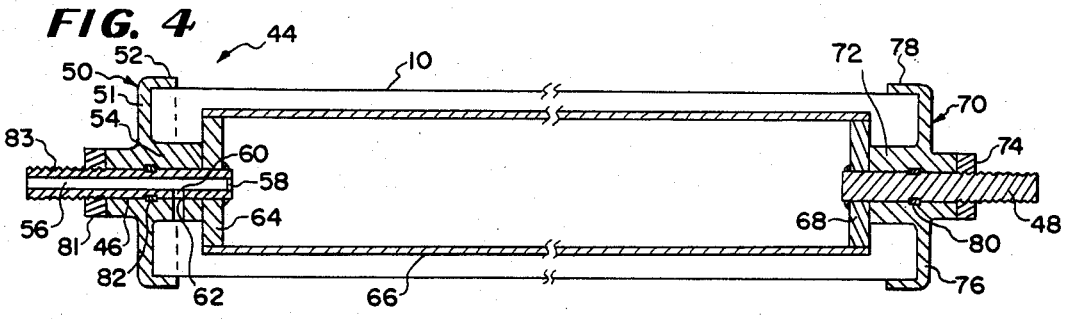
FIG. 4 is a median sectional view through a sleeve supporting device constructed in accordance with the invention.

In FIG. 4 there is illustrated in section a form of mounting upon which the cylinder 10 is arranged for use in a printing press. The mounting device 44 basically comprises a device in which the cylinder is suspended in cylindrical configuration and is kept inflated by means of a fluid such as oil or air or the like pumped into the interior of the cylinder 10 and maintained at a low pressure. It has been found that the cylinders 10 can be kept quite rigid and maintain their cylindrical configurations by means of pressures only slightly greater than atmospheric, say of the order of 0.5 to 0.7 of an atmosphere greater than ambient. This is considered a surprising result.

The cylinder ends must be tightly gripped in cylindrical configuration to prevent wrinkles and bulges.

In FIG. 4 the mounting device is basically formed of two stub shafts 46 and 48, the latter being solid and the former being hollow. A flange disc 50 has an inwardly directed annular cup-like flange 52 whose interior diameter is very closely the outer diameter of the sleeve 10. A hub 54 mounts the web 51 of the disc 50 on the hollow shaft 46 non-rotatably, the center of the shaft 46 having a through bore 56 whose inner end may be plugged at 58 but which is provided with a lateral opening at 60 that connects with a radial passageway 62 passing through the hub 54 but located axially interior of the web 51 of the disc 50, the web 51 being imperforate.

The interior end of the shaft 46 also has a large washer 64 secured thereto as by welding, the washer 64 supporting an elongate rigid metal cylinder 66 and being secured thereto, also by welding, for example. This cylinder is referred to in the claims as axially extending spacer means.

The opposite end of the cylinder 66 is attached to a second washer 68 that is welded to the shaft 48 so that both shafts 46 and 48 are aligned and rotate in unison. A second disc 70 has a central hub 72 that may be secured to the shaft 48 permanently or non-rotatable relative thereto but held in place by a nut such as 74. The body 76 of the disc is imperforate and has an inwardly directed cup-like annular flange 78 at its outer periphery having the same interior diameter as the flange 52.

Suitable packing may be provided at 80 and 82 to prevent the leaking of fluid outwardly of the disc 50 and 70.

The disc 50 is held in place by the nut 81 engaging over the threaded end 83 of the shaft 46.

In use, a sleeve 10 is shaped into a cylinder and fitted into the interior of the flange 78 and cemented in place with a suitable adhesive, primarily to render the telescoping connection fluid tight. The flange 50 is not in place at this time. After installing the right hand end of the sleeve 10, the disc 50 is moved telescopically over the left hand end of the sleeve 10 and again the connection is effected with a coating of adhesive in place to provide a second fluid tight connection. When the adhesive has set, the entire assembly is installed in a printing press such as the apparatus 16 and fluid such as air, hydraulic fluid or the like is admitted into the bore 56 through a suitable fitting attached to the left hand end of the shaft 46. This fitting is required to maintain the connection fluid tight while rotating, there being many such fittings known in the art. Such a fitting is indicated at 57, connected by line 59 to the fluid source 61.

The fluid is carried in the annular space between the central cylinder 66 and the sleeve 10 and it serves to maintain the sleeve 10 fully inflated and rigid during use. The presence of the inner sleeve enables a very small amount of fluid to be used to maintain the rigidity of the sleeve 10, and in the case of air or other gas being the fluid, the amount of pressure needed to maintain the inflated condition is lower than it would be if the shaft extended fully through the device and there was no cylinder 66. It is clear that the cylinder 66 functions to maintain the spacing between the discs 50 and 70 and to keep the shafts 46 and 48 in alignment and rotating together. The entire assembly is called a framework in the claims.

It should be pointed out that the internal pressure needed for keeping the cylinders inflated on a printing press is so low that readily available air pressure from commercial sources commonly provided in shops and factories will suffice. Further, since the method of transfer of ink to the substrate requires no mechanical pressure in the preferred structure in which the cylinders will be used, mechanical tension alone will be adequate to maintain the cylinders in their normal configuration in many instances.

Figure 5:
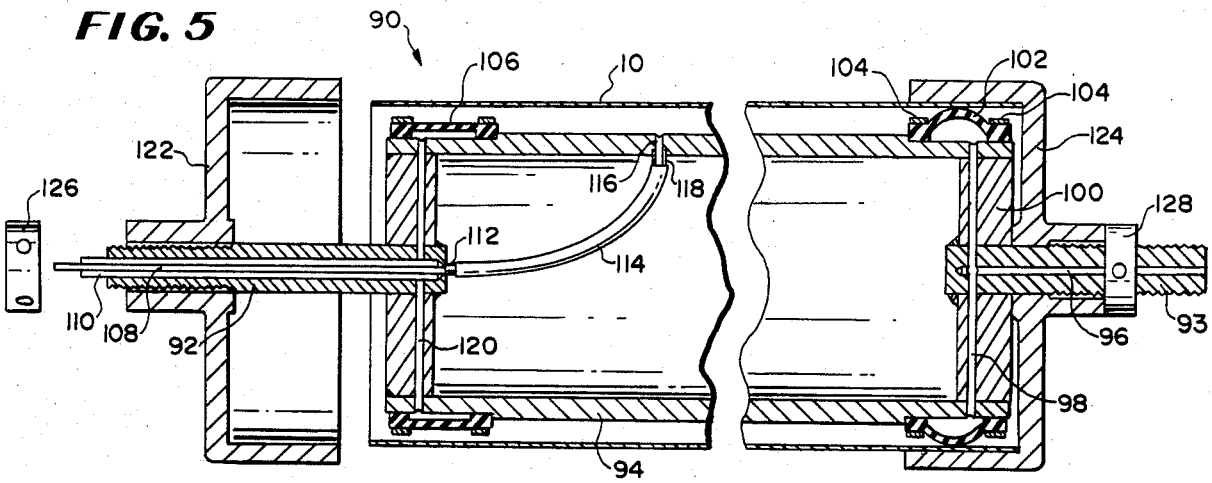
FIG. 5 is a similar view but partially exploded of a modified form of the invention.
Figure 6:
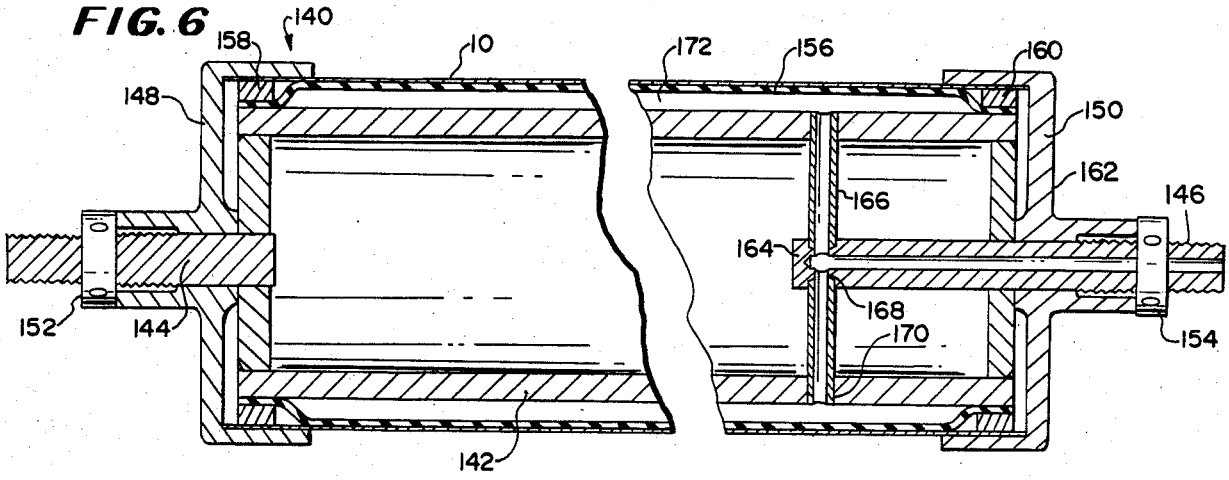
FIG. 6 is another similar view of a further modification of the invention.

Two other forms of the invention are illustrated, respectively in FIGS. 5 and 6, but the principals of construction and operation are basically the same for all of the cylinder supporting devices including that of FIG. 4. Each has means for clamping or seizing the ends of the cylinder 10 in a fluid tight connection while shaping the same to form the cylindrical configuration, each has means for admitting a fluid to the interior of the cylinder to inflate it if required but at least to maintain it in rigid cylindrical configuration, and each has means for mounting the device onto a printing press. It should be understood that although the practical manner of introducing the fluid and maintaining the internal pressure is by having structure on the printing press which connects with the cylinder-supporting device while the cylinder is rotating, it is nevertheless possible to have the cylinder-supporting device provided with means that pumps the fluid into the interior of the cylinder and is sealed under some pressure so that the entire device is maintained in its fully expanded condition independently of the printing machine.

The mounting device 90 of FIG. 5 differs primarily from that of FIG. 4 in that the ends of the cylinder are held in place by means of pneumatic or hydraulic expandable cushions. Thus, there is a pair of stub shafts 92 and 93 which have the interior rigid cylinder 94 secured to their inner ends, respectively, but both of these shafts are hollow. The right hand shaft 93 has a single bore 96 which connects to one or more radial passageways 98 in the washer end 100 of the cylinder 94 leading to the interior of an inflatable elastomeric cushion 102 clamped to the end of the cylinder 94 by suitable bands 104. The securement may be by room temperature vulcanizing adhesive or other adhesive.

A similar cushion 106 shown in deflated condition is provided on the left hand end of the cylinder 94, since this end is shown in condition while it is being assembled. The shaft 92 differs from the shaft 93 and that of FIG. 4 in that it has concentric passageways, there being a central bore or pipe 108 and a larger telescoping second bore 110, these being located within one another and being independent of one another. The central passageway formed by the bore 108 is connected through a fitting 112 by way of a short length of conduit 114 through the interior of the cylinder 94 to a lateral opening 116 to which it is connected by a suitable fitting 118. The outer bore 110 connects to one or more radial passageways 120 leading to the interior of the cushion 106.

Assembly is effected by moving the end cup-shaped discs 122 and 124 into telescoping engagement with the cylinder 10 taking up on the nuts 126 and 128, introducing a first fluid into the bores 96 and 108 to inflate the cushions 104 and 106 to clamp the sleeve 10 in place and thereafter introducing the fluid into the interior pipe 108 to maintain the sleeve 10 as a rigid cylinder. The second fluid is held between the inner cylinder 94 and the interior of the sleeve 10. Shaft packing is not deemed necessary in the device 90.

The structure of FIG. 5 which is not specifically described is detailed either in other parts of FIG. 5 or in FIG. 4.

In FIG. 6 there is illustrated a device 140 which utilizes an elastomeric boot of cylindrical configuration to maintain the sleeve 10 rigid so that no fluid will be engaged against the interior of the sleeve and so that it is not essential that the engagement of the sleeve 10 in the end discs be fluid tight. Thus, in this device there is again an inner rigid cylinder 142 connected with a pair of end stub shafts 144 and 146 upon which there are engaged the discs 148 and 150 by means of the nuts 152 and 154, respectively. On the exterior of the cylinder 142 there is mounted an elongate elastomeric sleeve-like boot 156 whose ends are tight clamped to the exterior of the cylinder 142 by any suitable means such as the annular bands 158 and 160. The hollow bore 162 of the shaft 146 terminates axially within the cylinder 142 at 164 at which point it is connected by way of the conduits 166 connected at 168 to openings in the side wall of the cylinder 142, as for example at 170. There is thus provided passage for fluid from the exterior of the cylinder 142 by way of the bore 162 to the chamber 172 formed on the interior of the boot 156 and the outer surface of the cylinder 142.

The assembly of the device 14 and the method of inflation are easily effected since everything may be in place at one end, say the right hand end, the sleeve 10 slipped in place into the cup of the disc 150 while no fluid is present, the second disc 148 telescopically engaged over the left hand end of the sleeve, the nut 152 screwed home and fluid applied. This inflates the boot 156 and rigidifies the sleeve 10. This will form a rather firm base for the sleeve 10 during use.

Figure 7:
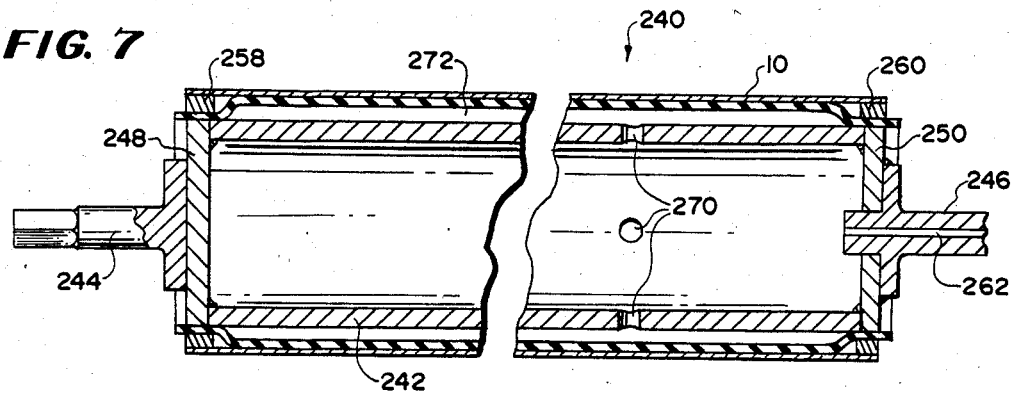
FIG. 7 is a sectional view similar to that of FIG. 6 showing a variation of the structure of FIG. 6.

In FIG. 7 another device 240 is illustrated in which the equivalent components of FIG. 6 are designated by the same second and third numerals and the numeral "2" as the first. The principal differences between the devices 140 and 240 lie in the fact that the entire interior of the cylinder 242 carriers the fluid, which in this case is a gas and the fact that the end washers of the cylinder 242 function both as such washers and the discs 148 and 150. Thus they carry reference numerals 248 and 250. The fluid is admitted by way of bore 262 in shaft 246 and finds its way into the chamber 172 through passageways 270.

The structure 240 is advantageous in eliminating parts comprising outer cup-shaped discs so that there need be no part of the device 240 protruding radially beyond the sleeve 10 itself. Thus the device is lighter in weight, simpler to construct, and more economical than the device 140.

Variations are capable of being made in the invention without departing from the spirit or scope thereof as defined in the appended claims.

What it is claimed and desired to secure by Letters Patent of the United States is:

1. A method of mounting an elongate collapsed imperforate flexible thin-walled metal sleeve having a thickness of the order of one millimeter which is capable of being readily collapsible along its length but sufficiently stiff to prevent axial collapse for mounting on a frame for use in a rotary printing press which method comprises providing a framework adapted to be rotated, shaping the ends of said collapsed sleeve into a circular configuration, sealably engaging only the ends of the sleeve leaving the remaining length of the sleeve mechanically unsupported, sealing said ends and containing them against axial movement and applying fluid pressure to the interior of the collapsed sleeve to inflate the same uniformly along said mechanically unsupported length to rigidify same in a right cylindrical configuration having a uniform overall diameter equal to the diameter of the sleeve ends, and to thereby establish a fluid filled continuous chamber extending laterally along the length of the inner wall of said sleeve to maintain said diameter dimensions during use in the printing press.

2. Apparatus for supporting an imperforate flexible thin-walled metal sleeve which is sufficiently stiff to prevent axial collapse but laterally collapsible when mechanically unsupported, for use as an ink transfer device in a printing press, said apparatus comprising:

A. an elongate framework, including shaft means, having opposite ends for connecting the framework into a printing press to be rotated thereby, a disc member at each end of the framework connected respectively to one of said shaft means ends, each disc member adapted to have one end of a thin-walled metal sleeve coupled thereto and circularly shaped thereby, means associated with each disc member to engage the sleeve to said framework supporting said sleeve only at the ends thereof and axial spacer means extending axially and connected between said shaft means ends for fixedly spacing the disc members apart, defining an annular generally continuous empty area between the spacer means and the sleeve, said spacer means further maintaining the spacing during the use of the apparatus, B. the axially extending spacer means being arranged to have such a length as to form the sleeve into cylindrical configuration in cooperation with the disc members and comprising an elongate rigid cylinder whose outer diameter is less than the inner diameter of the sleeve, the empty space being defined between the outer surface of the rigid cylinder and the inner surface of the sleeve when it is installed, C. means for applying uniform pressure on the interior of the sleeve by way of said spacer means to each and every increment of said sleeve in order to maintain its cylindrical configuration rigid and of uniform diameter over its length in the absence of mechanical support along said length during use of the apparatus, D. said means for applying pressure including means for introducing fluid under pressure in the framework and transmitting the pressure into the cylindrical empty space when the sleeve is installed in place, the ends of the cylinder having washers closing same off, the shaft means being coaxial with the washers, the disc members being mounted on the shaft means, and the fluid introducing means by-passing the cylinder on the exterior thereof.

3. The apparatus as claimed in claim 2 in which the disc members have inwardly directed axially extending annular flanges, the sleeve adapted to be secured on the interior of the flanges.

4. Apparatus for supporting an imperforate thin-walled metal sleeve which is flexible unsupported, for use as an ink transfer device in a printing press which comprises:

A. an elongate framework comprising a rigid hollow cylinder having end washers closing the same and shafts connected to the respective washers and axially extending outwardly relative to the cylinder with means on the shaft ends for connecting the framework into a printing press to be rotated while in the press, B. said framework including a disc member at each end of the cylinder connected respectively to the shafts and adapted to rotate with the framework, each disc member having a peripheral, annular, axially extending relatively short flange with the flanges and discs forming cup-like formations opening toward one another and having the inner diameter thereof larger than the exterior diameter of the cylinder, at least one of the discs being movable axially to the other disc and capable of being secured in a predetermined axial position, C. each cup-like formation adapted to have one end of a thin-walled metal sleeve coupled thereto and circularly shaped thereby, there being means to fix the position of the movable disc at a location relative to the other disc and the cylinder when the sleeve is in place so that the sleeve will form a second hollow cylinder coaxially of the first cylinder and surrounding the same and means for introducing a pressurized fluid into the space between cylinders by way of at least one of said shafts and including a passageway leading from said shaft to said space at a location axially outward of said cylinder.

5. The apparatus as claimed in claim 4 and including in combination a thin-walled metal sleeve having its ends adhesively engaged with said flanges in stretched condition and being normally collapsed.

6. Apparatus for mounting an imperforate thin-walled flexible metal sleeve whose developed configuration is that of a right cylinder, but whose wall thickness if of the order of one millimeter, said sleeve being sufficiently stiff enough to prevent axial collapse but sufficiently flexible readily to be collapsible laterally in the absence of mechanical support, said apparatus comprising:

A. an elongate framework, coaxial shaft means connected to the framework, said shaft means having opposite ends capable of connecting the framework with a printing press for rotation therein, disc members connected to respective shaft means ends, means associated with each disc member to effect a sealed mounting and coupling of said disc member with only each opposite end of the laterally collapsed metal sleeve circularly to shape said sleeve ends, B. coaxially extending spacer means connected between the shaft means ends for fixedly spacing the disc members apart to define an annular generally continuous empty intermediate longitudinally extending axial chamber about the interior of the framework defined between said spacer means and said sleeve, and C. means for introducing fluid under pressure into the framework to said empty space by way of said spacer means when said sealed coupling is established to apply fluid pressure to each and every increment of the interior of the collapsed sleeve to inflate same and rigidify same uniformly establishing a uniform diameter over the entire length of the inflated rigidified sleeve, said inflated diameter being equal to the diameter of the mounted ends of said sleeve.

7. The apparatus as claimed in claim 6 in which the means for introducing fluid upper pressure comprise a least a passageway through said shaft means, means for connecting said passageway to an external source of fluid under pressure and the passageway connecting internally with the interior of the sleeve when said sleeve is so mounted and coupled.

8. An ink transfer device for a printing press comprising:

A. an imperforate metal thin-walled sleeve of a thickness of the order of a fraction of a millimeter and having an outer circumferential thin film coating of a flexible wholly inorganic microcrystalline, readily chargeable photoconductive coating, said sleeve having a stiffness sufficient to prevent axial collapsing but capable of being readily collapsible laterally along its length particularly when structurally unsupported along said length during use, B. a mounting structure for supporting said sleeve only at its opposite ends, said mounting structure having i. an elongate framework ii. coaxial shaft means connected to said framework, said shaft means having opposite outwardly extending ends capable of connecting the framework into a printing press for rotation therein, disc members located one at each end of the framework and connected respectively to said shaft means at opposite ends thereof, iii. means associated with each disc member for engaging each end of said metal sleeve forming said ends into a circular configuration with the overall sleeve assuming a right cylindrical configuration during use in a printing press, iv. coaxial spacer means connected to said shaft means defining an annular generally continuous hollow chamber between said spacer means and the inner wall of the sleeve extending laterally along its length and, means for applying uniform fluid pressure on the interior of the sleeve by way of said spacer means to inflate same laterally over each and every increment of said sleeve along its length during use to provide a rigid right cylindrical configuration the overall diameter of which is uniform and equal to the diameter of the sleeve at the ends thereof when same is formed into circular configuration and in the absence of mechanical support between its ends during use of the printing press, said means for applying pressure include means for introducing fluid under pressure in the framework and transmitting the pressure into the said annular chamber subsequent to installation of the sleeve as mounted to said mounting structure and in place in the printing press.

9. The apparatus as claimed in claim 8 in which the means for introducing pressure also include at least one passageway through the shaft means and means for connecting said passageway to an external source of fluid under pressure.

10. The apparatus as claimed in claim 8 in which the means for introducing pressure include at least one passageway coaxial with and through the shaft means, the inner end of said passageway communicating with the interior of the sleeve and the outer end of said passageway terminating at one of the shaft means ends, said means associated with each disc member to engage the sleeve to said framework effecting a fluid tight connection, and the said one shaft means end capable of being coupled to a source of fluid under pressure introduced exterior of said framework for introduction thereof into said one passageway.

11. The apparatus as claimed in claim 8 in which the coaxial spacer means comprise an elongate rigid cylinder whose outer diameter is less than the inner diameter of the sleeve.

12. The apparatus as claimed in claim 11 in which the means for applying pressure include means for introducing fluid under pressure in the framework and transmitting the pressure into the cylindrical empty space when the sleeve is installed in place.

13. The apparatus as claimed in claim 11 in which the means for applying pressure include at least one passageway through the shaft means and connecting conduit means between the passageway and said chamber and between said passageway and an exterior source of fluid under pressure.

14. The apparatus as claimed in claim 12 in which the means for introducing pressure include at least one passageway through the shaft means and conduit means for connecting said passageway to an external source of fluid under pressure.

15. A printing press having at least one ink transfer apparatus as claimed in claim 9 which includes means for mounting said apparatus for rotation, an external source of fluid under pressure and means providing a rotatable fluid coupling from said external source of fluid under pressure to said passageway connecting means whereby to apply fluid pressure to the interior of the apparatus during rotation.

16. The apparatus as claimed in claim 14 which includes means for mounting said apparatus for rotation, an external source of fluid under pressure and means providing a rotatable fluid coupling with said conduit means whereby the fluid under pressure is introduceable to said chamber during rotation.

* * * * *